US006957714B2

(12) United States Patent
Takahashi et al.

(10) Patent No.: US 6,957,714 B2
(45) Date of Patent: Oct. 25, 2005

(54) SPEAKER AND SPEAKER DIAPHRAGM

(75) Inventors: Osamu Takahashi, Yamagata (JP); Ryo Ishiyama, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 227 days.

(21) Appl. No.: 10/617,784

(22) Filed: Jul. 14, 2003

(65) Prior Publication Data

US 2004/0007420 A1 Jan. 15, 2004

(30) Foreign Application Priority Data

Jul. 12, 2002 (JP) ..... P2002-204689

(51) Int. Cl.[7] ..... G10K 13/00; H04R 7/16; H04R 7/14; H04R 9/04

(52) U.S. Cl. ..... 181/171; 181/172; 181/173; 381/392; 381/429

(58) Field of Search ..... 181/166–173; 381/423, 202, 386, 392, 426–429

(56) References Cited

U.S. PATENT DOCUMENTS

| | | | | | |
|---|---|---|---|---|---|
| 1,832,608 | A | * | 11/1931 | Abrahams | 181/171 |
| 1,844,487 | A | * | 2/1932 | Tyrrell | 181/164 |
| 1,990,409 | A | * | 2/1935 | Lawrence | 181/164 |
| 2,302,178 | A | * | 11/1942 | Brennan | 181/169 |
| 2,439,665 | A | * | 4/1948 | Marquis | 181/169 |
| 2,531,634 | A | * | 11/1950 | Lawrance | 181/164 |
| 2,863,520 | A | | 12/1958 | Manley et al. | |
| 4,324,312 | A | * | 4/1982 | Durbin | 181/171 |
| 4,433,214 | A | * | 2/1984 | Jasinski | 381/398 |
| 4,581,496 | A | * | 4/1986 | Sweany | 381/429 |
| 5,590,211 | A | * | 12/1996 | Chang | 381/398 |
| 5,647,007 | A | * | 7/1997 | Wooderson et al. | 381/332 |
| 6,516,077 | B1 | * | 2/2003 | Yamaguchi et al. | 381/424 |
| 6,611,604 | B1 | * | 8/2003 | Irby et al. | 381/398 |
| 2002/0051558 | A1 | | 5/2002 | Kuze et al. | |
| 2003/0070869 | A1 | * | 4/2003 | Hlibowicki | 181/172 |

FOREIGN PATENT DOCUMENTS

| | | | | | |
|---|---|---|---|---|---|
| GB | 2 230 677 | A | | 10/1990 | |
| JP | 58221597 | A | * | 12/1983 | H04R 7/20 |
| JP | 61276499 | A | * | 12/1986 | H04R 7/20 |
| JP | 07023497 | A | * | 1/1995 | H04R 7/20 |
| JP | 09224297 | A | * | 8/1997 | H04R 7/14 |
| JP | 11313391 | A | * | 11/1999 | H04R 7/20 |
| JP | 2002271887 | A | * | 9/2002 | H04R 9/02 |

OTHER PUBLICATIONS

Japanese Abstract No. 58199000, dated Nov. 19, 1983.
Japanese Abstract No. 61276499, dated Dec. 6, 1986

* cited by examiner

*Primary Examiner*—Edgardo San Martin
(74) *Attorney, Agent, or Firm*—Sughrue Mion, PLLC

(57) ABSTRACT

The speaker has a diaphragm main body 30 supported resiliently on a frame 23 via an edge portion 31 around its outer circumference, and the groove ribs 35 integrally formed in the edge portion 31, wherein a regulation member 37 for partially improving a flexural strength of the edge portion 31 is provided on a part of the front or back face of the edge portion 31.

12 Claims, 5 Drawing Sheets

FIG. 5

| | CONVENTIONAL EXAMPLE | EMBODIMENT |
|---|---|---|
| S01* (AVERAGE OF 2, 2.5, 3, 4kHz) | 86.81dB | 86.71dB |
| S02* (AT 1kHz) | 91.26dB | 91.52dB |
| $f_0$ | 780.8dB | 815.3dB |
| THD1* (700-1kHz) | 12.28dB | 11.74dB |
| THD2* (1-2kHz) | 8.15dB | 4.94dB |
| THD3* (5-15kHz) | 7.15dB | 11.34dB |

* MEASUREMENT CONDITIONS: JISBOX, INPUT 0.1W, MICROPHONE DISTANCE 10cm

* TDH2: DISTORTION DUE TO ROLLING

SPEAKER AND SPEAKER DIAPHRAGM

The present disclosure relates to the subject matter contained in Japanese Patent Application No. 2002-204689 filed on Jul. 12, 2002, which is incorporated herein by reference in its entirety.

BACKGROUND OF THE INVENTION

1. Field of the Invention

The present invention relates to a speaker and a speaker diaphragm, and more particularly to a speaker of small diameter and a speaker diaphragm.

2. Description of the Related Art

Conventionally, a speaker of small diameter has been employed in an audio system for vehicle because of a limited installation space.

The reproduction limit of low sound in the speaker depends on a low sound resonance frequency $f_0$ as a rule of thumb, and this value is represented by the following expression (1), $$f_0=(1/2\pi)(s_0/m_0)^{1/2} \quad (1)$$

where $m_0$(gr) is an effective mass of a vibration system, and $s_0$(dyne/cm) is a stiffness (flexural rigidity (hardness) for enabling less vibration of a diaphragm main body) of a support portion for the vibration system. Accordingly, in order to decrease the reproduction limit of low sound, the stiffness $s_0$ is reduced by making flexible an edge portion, which resiliently supports the diaphragm main body on the frame, or the weight of a diaphragm or a voice coil is increased to make the effective mass $m_0$ greater.

For the speaker of small diameter, it is requisite to lighten the weight of the diaphragm to miniaturize a coil or a magnetic circuit for driving the diaphragm, whereas it is less negligible to enhance the reproducing capacity of low sound range to aim at the high quality reproduction.

In designing the speaker of small diameter, if the effective mass $m_0$ of the vibration system is decreased for lighter weight, the stiffness $s_0$ must be reduced by an excess amount. Thereby, to sufficiently reduce the stiffness $s_0$, it is required to contrive the structure of the edge portion provided around the outer circumference of the diaphragm main body to resiliently support the diaphragm main body on the frame or the linkage structure between the edge portion and the frame.

From such a background, the speaker for use in the audio system for vehicle has hitherto employed a thin film for the diaphragm to lighten the weight. Furthermore, the edge portion 1 provided around the outer circumference of the diaphragm main body to resiliently support the diaphragm main body on the frame has a plurality of groove ribs 3 integrally molded to enhance the reproducing capacity of low sound range, as shown in FIG. 7.

This rib 3 is a groove having a V-character shape in transverse section, so-called a tangential edge, which extends in a tangential direction of the inner circumferential edge 1*a* (i.e., outer circumferential edge of the diaphragm main body) of the edge portion 1 and is disposed at an equal interval in a circumferential direction. This rib 3 increases the flexural rigidity in an extending direction of the groove (i.e., a tangential direction of the outer circumferential edge of the diaphragm main body), but serves to decrease the flexural rigidity due to an expansion or contraction of the groove width in a crossing direction of the groove (i.e., a radial direction of the diaphragm main body). Consequently, the rib 3 makes the diaphragm easy to move and reduces the stiffness $s_0$.

However, if the stiffness so is reduced excessively, the diaphragm main body causes the reproduced sound to be distorted, or gives rise to a rolling-that is a factor of causing the noise due to the mutual contact of a vibration mechanism, resulting in the risk of degrading the quality of reproduced sound. Thereby, there was the problem that the reproducing capacity of low sound range could not be enhanced only by reducing the stiffness $s_0$.

Further, an improved method of low sound range by forming the rib 3 had a drawback that since the rib 3 is intermittently disposed, the reinforcement or easiness of deformation of the rib 3 can not be attained uniformly over the entire area of the edge portion 1, and the edge portion 1 is fixed to the frame less uniformly over the entire circumference, whereby there is the possibility that the load on the edge portion 1 becomes maximum in a specific region due to a vibration propagation at the time of reproducing the sound. Due to the above reasons, when an input signal was large (large input), or the diaphragm was made thinner, there was the risk that the quality of reproduced sound was degraded due to the rolling of the edge portion or the local distortion. Also, there was the risk that the rolling might occur when the weight or compliance was unbalanced to lay a voice coil lead wire on the edge portion 1.

SUMMARY OF THE INVENTION

The present invention has been achieved in the light of the above-mentioned problems, and it is an object of the invention to provide a speaker and a speaker diaphragm with the higher reproducing capacity of low sound range by forming a plurality of ribs in the edge portion to reduce the stiffness $s_0$, in which the reproducing performance of low sound range is enhanced by supplementing a drawback that occurs by forming the rib to reduce the stiffness $s_0$, and the occurrence of the rolling is suppressed, whereby the high quality reproduction of sound with less distortion is realized even at the time of large input.

In order to accomplish the above object, according to a first aspect of the invention, there is provided a speaker including a frame; a diaphragm main body supported resiliently on the frame via an edge portion around outer circumference thereof; a groove rib integrally molded in the edge portion; and a regulation member provided on a part of the front or back face of the edge portion, and adapted to partially improve a flexural strength of the edge portion.

According to a second aspect of the invention, there is provided a speaker diaphragm including a diaphragm main body integrally formed with an edge portion around outer circumference thereof; a groove rib integrally formed in the edge portion; a regulation member provided on a part of the front or back face of the edge portion, and adapted to partially improve a flexural strength of the edge portion.

In the speaker and the speaker diaphragm configured above, the regulation member provided in the edge portion increases the effective mass of the vibration system, and decreases the low sound resonance frequency $f_0$ by increasing $m_0$ in the expression (1) for calculating the low sound resonance frequency $f_0$. Accordingly, the lower stiffness $s_0$ of the support portion of the vibration system and the increased effective mass $m_0$ of the vibration system by disposing the ribs can cooperate to enhance the reproducing performance of low-sound range, thereby easily enhancing the reproducing capacity of low sound range. The regulation member provided in the edge portion may be disposed between the ribs formed on the edge portion or on the rib, whereby it is possible to extend the reinforcing effect of the rib to a wider range, or to supplement the drawback that occurs when the stiffness $s_0$ is reduced, because the rib is reinforced over a local region having less flexural strength in the edge portion caused by an individual difference in assembling. Accordingly, the acceptable input is increased as compared with the conventional practice where the greater reproducing performance of low sound range relied only on reducing the stiffness $s_0$, whereby the occurrence of the rolling is suppressed at the time of large input and the high quality reproduction with less distortion is realized.

Preferably, the regulation member may be formed by applying an adhesive or an agglutinant. In this manner, the hardness or weight of the regulation member is easily balanced by adjusting the amount of the adhesive or the agglutinant applied. Also, there is no need for increasing the number of parts.

More preferably, a plurality of the regulation members made of different materials may be provided. Also, a plurality of the regulation members having different sizes may be provided. In this manner, even if there is a minute difference in the reproducing performance between individuals owing to an assembling error or a tolerance of components, it is possible to make the fine adjustments for the reproducing performance to eliminate a dispersion in the reproducing performance between the products caused by individual differences in assembling, thereby stably producing the speaker that can make the high quality reproduction.

Preferably, the regulation member may be provided within a grooved portion of the groove rib. In this manner, the positioning operation in providing the regulation member is facilitated.

BRIEF DESCRIPTION OF THE DRAWINGS

The above objects and advantages of the present invention will become more apparent by describing in detail preferred exemplary embodiments thereof with reference to the accompanying drawings, wherein:

FIG. 5 is a table listing the output sound pressure level and the total harmonic distortion rate in the conventional speaker and the speaker according to the embodiment;

DETAILED DESCRIPTION OF THE PREFERRED EMBODIMENTS

Referring now to the accompanying drawings, an embodiment of the invention will be explained in detail as follows.

Figure 1:
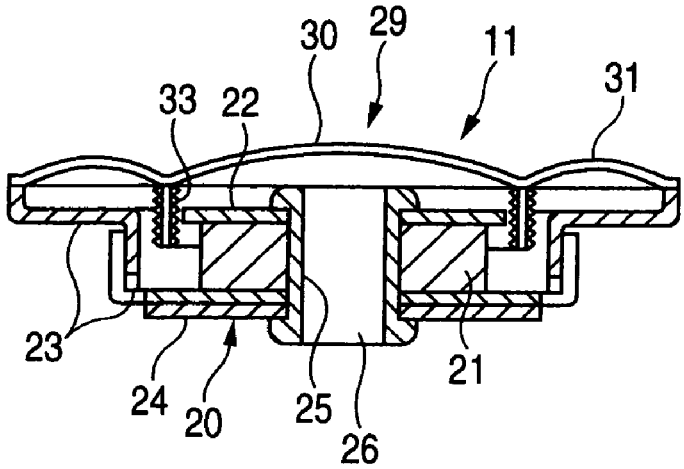
FIG. 1 is a longitudinal cross-sectional view of a speaker according to one embodiment of the present invention.

A speaker according to one embodiment of the present invention will be described below with reference to the accompanying drawings. FIG. 1 shows the speaker according to one embodiment of the invention.

The speaker 11 of this embodiment is employed in an audio system for vehicle, in which a magnetic circuit 20 is composed of a magnet 21, a pole piece 22, a yoke frame 23, and a base plate 24, in which a bore 25 is provided concentrically in the central portion thereof, and the magnetic circuit 20 is integrated by caulking both ends of an eyelet 26 inserted through the bore 25.

A diaphragm 29 is composed of a diaphragm main body 30 and a ring-like edge portion 31 leading to the outer circumference of the diaphragm main body 30. Because the outer circumferential edge of the edge portion 31 is joined with a rising portion around the outer circumference of the yoke frame 23, the diaphragm main body 30 is resiliently supported to be displaceable with respect to the yoke frame 23. Also, a voice coil 33 bonded on the backside of the diaphragm main body 30 is received movably in a magnetic gap between the yoke frame 23 and the magnet 21.

Figure 2:
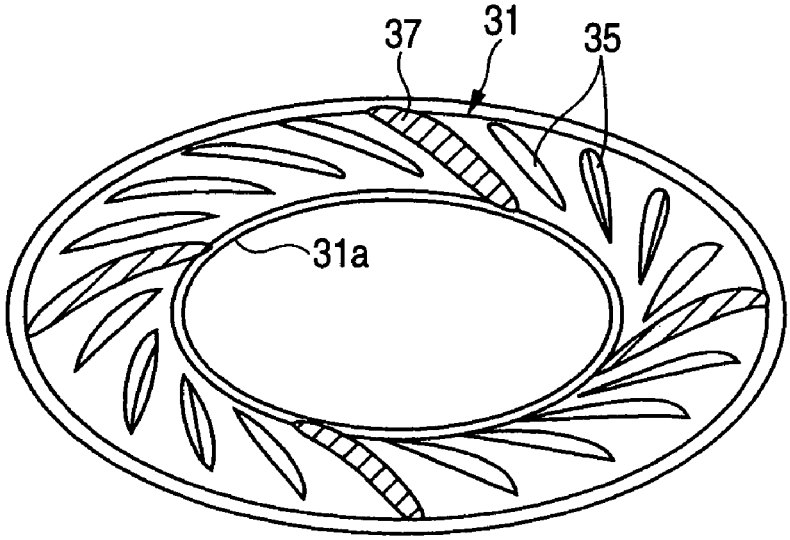
FIG. 2 is a perspective view showing an edge portion in the speaker as shown in FIG. 1.

The edge portion 31 has a plurality of groove-like ribs 35 integrally molded to enhance the reproducing capacity of low sound range, as shown in FIG. 2. The rib 35 is a groove having a V-character shape in transverse section, so-called a tangential edge, which extends in a tangential direction of the inner circumferential edge 31*a* (i.e., outer circumferential edge of the diaphragm main body 30) of the edge portion 31 and is disposed at an equal interval in a circumferential direction. This rib 35 increases the flexural rigidity in an extending direction of the groove (i.e., tangential direction of the outer circumferential edge of the diaphragm main body 30), but serves to decrease the flexural rigidity due to an expansion or contraction of the groove width in a crossing direction of the groove (i.e., radial direction of the diaphragm main body 30), so that the diaphragm main body is easily displaced to make the diaphragm easy to move and reduce the stiffness $s_0$.

In the embodiment, a regulation member 37 of predetermined size for partially improving the flexural rigidity of the edge portion 31 is provided on a part of the surface of the edge portion 31. The regulation member 37 is formed by applying an adhesive or an agglutinant in the embodiment. The adhesive or the agglutinant used maybe preferably vinyl acetate, acrylic rubber or butyl rubber damping agent.

In the embodiment, the regulation member 37 is disposed on the rib 35 to cover the rib 35. The regulation member is disposed at an equal interval, but when the edge portion 31 has a remarkable dispersion in the vibration performance in the circumferential direction, the regulation member 37 may be disposed at an unequal interval in the circumferential direction in the sense of eliminating the dispersion and equalizing the vibration performance in the circumferential direction.

The regulation members 37 made of different materials or having different sizes may be provided.

In the speaker 11 thus configured, the regulation member 37 provided in the edge portion 31 increases the effective mass of the vibration system, and decreases the low sound resonance frequency $f_0$ by increasing the effective mass $m_0$ of the vibration system in the previous expression (1) for calculating the low sound resonance frequency $f_0$. Accordingly, the lower stiffness so for the support portion of the vibration system and the increased effective mass $m_0$ of the vibration system can cooperate to enhance the reproducing performance of low sound range by disposing the ribs 35, thereby easily enhancing the reproducing capacity of low sound range.

The regulation member 37 provided in the edge portion 31 may be disposed between the ribs 35 formed on the edge portion 31 or on the rib 35, whereby it is possible to extend the reinforcing effect of the rib to a wider range, or to supplement the drawback that occurs when the stiffness $s_0$ is reduced because the rib 35 is reinforced over a local region having less flexural strength in the edge portion 31 caused by an individual difference in assembling. Accordingly, the acceptable input is increased as compared with the conventional practice where the greater reproducing performance of low sound range relied only on reducing the stiffness $s_0$, whereby the occurrence of the rolling is suppressed at the time of large input and the high quality reproduction with less distortion is realized.

Figure 3:
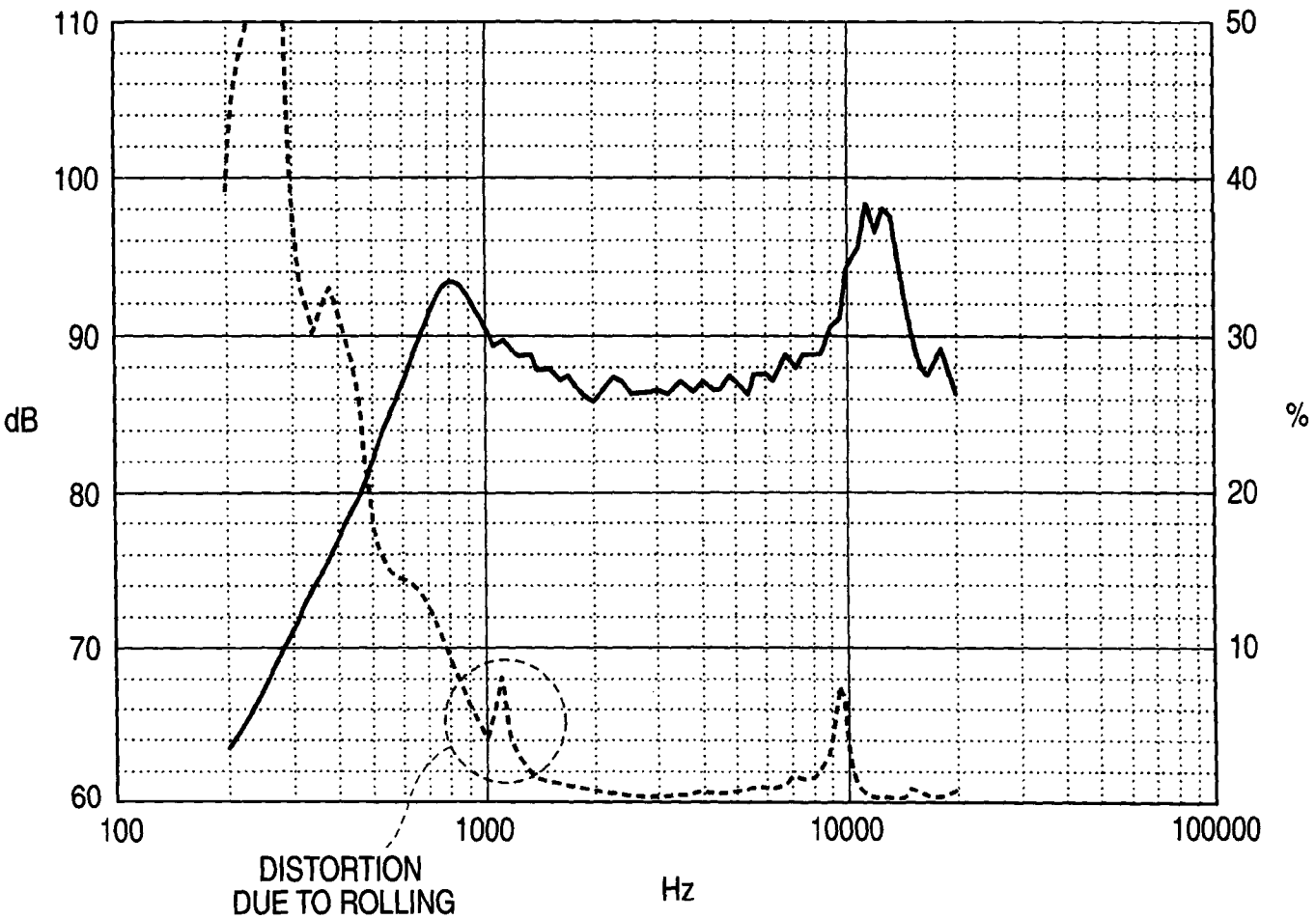
FIG. 3 is a graph representing the frequency characteristics of an output sound pressure level (solid line) and the total harmonic distortion rate (broken line) in the conventional speaker.
Figure 4:
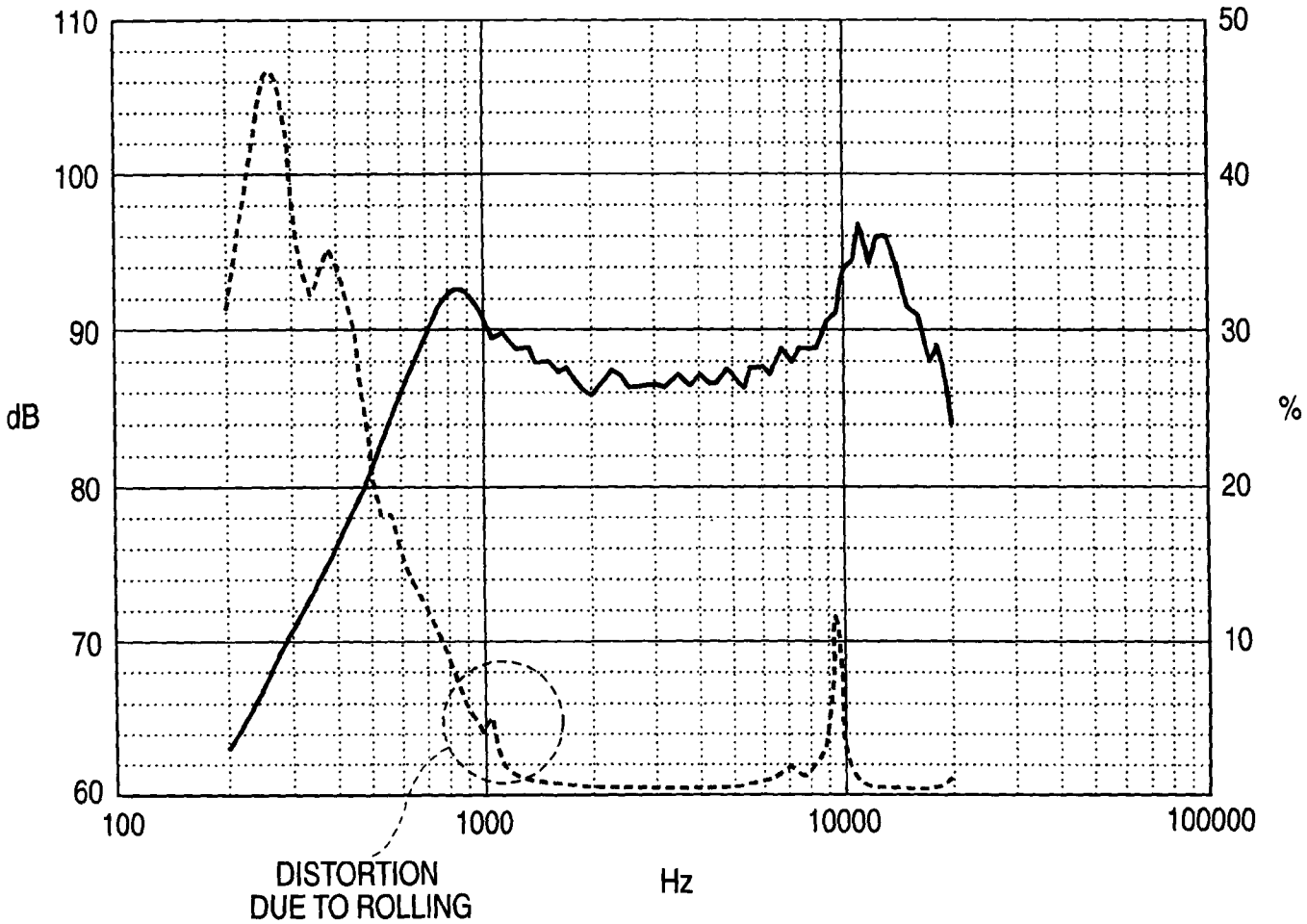
FIG. 4 is a graph representing the frequency characteristics of an output sound pressure level (solid line) and the total harmonic distortion rate (broken line) in the speaker according to the embodiment.

FIG. 3 is a graph representing the frequency characteristics of an output sound pressure level (solid line) and the total harmonic distortion rate (broken line) in the conventional speaker. FIG. 4 is a graph representing the frequency characteristics of an output sound pressure level (solid line) and the total harmonic distortion rate (broken line) in the speaker according to the embodiment. FIG. 5 is a table listing the output sound pressure level and the total harmonic distortion rate in the conventional speaker and the speaker according to the embodiment. As will be clearly seen from FIGS. 3 to 5, with the speaker of this embodiment, the distortion by rolling could be decreased from 8.15% to 4.94% (see THD2 in FIG. 5).

Figure 6:
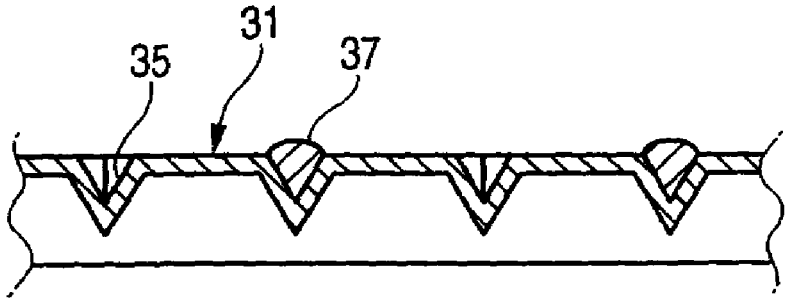
FIG. 6 is a cross-sectional view showing a speaker according to another embodiment of the invention.
Figure 7:
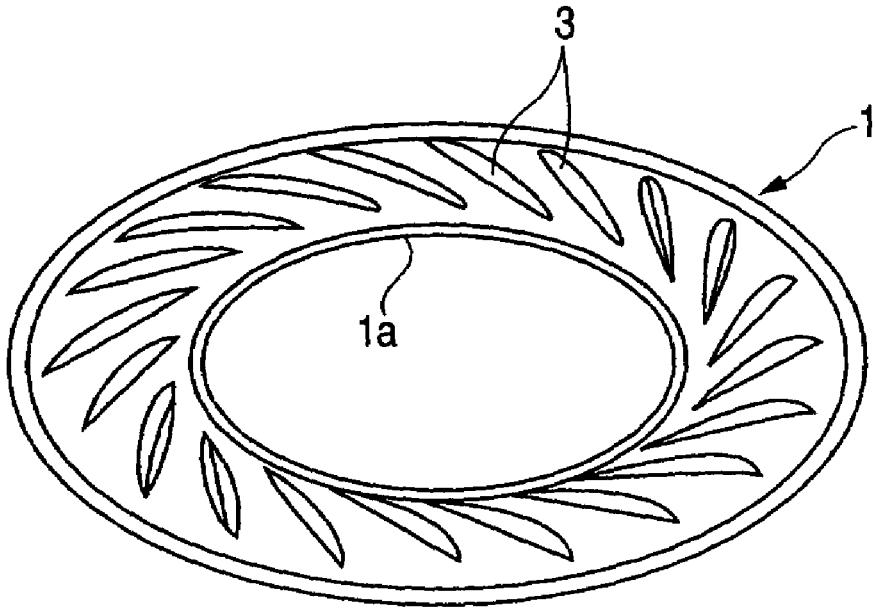
FIG. 7 is a perspective view showing an edge portion in the conventional speaker.

In the above embodiment, the regulation member 37 is provided on the rib 35 to cover the rib 35, whereas it may be provided within a grooved portion of the rib 35, as shown in FIG. 6. In this manner, the positioning operation for the regulation member 37 can be facilitated.

In the above embodiment, the regulation member 37 is provided on the surface of the edge portion 31, whereas the regulation member 37 may be provided on the back face of the edge portion 31.

As will be clear from the above description, with the speaker and the speaker diaphragm of this invention, the regulation-member provided in the edge portion increases the effective mass of the vibration system, and decreases the low sound resonance frequency $f_0$ by increasing the effective mass m0 in the expression (1) for calculating the low sound resonance frequency $f_0$. Accordingly, the lower stiffness s0 of the support portion of the vibration system and the increased effective mass $m_0$ of the vibration system by disposing the ribs can cooperate to enhance the reproducing performance of low sound range, thereby easily enhancing the reproducing capacity of low sound range. The regulation member provided in the edge portion may be disposed between the ribs formed on the edge portion or on the rib, whereby it is possible to extend the reinforcing effect of the rib to a wider range, or to supplement the drawback that occurs when the stiffness $s_0$ is reduced, because the rib is reinforced over a local region having less flexural strength in the edge portion caused by an individual difference in assembling. Accordingly, the acceptable input is increased as compared with the conventional practice where the greater reproducing performance of low sound range relied only on reducing the stiffness $s_0$, whereby the occurrence of the rolling is suppressed at the time of large input and the high quality reproduction with less distortion is realized.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A speaker comprising:

a frame;

a diaphragm main body supported resiliently on the frame via an edge portion around outer circumference thereof;

a groove rib integrally molded in the edge portion; and a regulation member provided on a part of the front or back face of the edge portion, and adapted to partially improve a flexural strength of the edge portion.

2. The speaker as claimed in claim 1, wherein the regulation member is formed by applying an adhesive.

3. The speaker as claimed in claim 1, wherein the regulation member is formed by applying an agglutinant.

4. The speaker as claimed in claim 1, wherein a plurality of the regulation members made of different materials are provided.

5. The speaker as claimed in claim 1, wherein a plurality of the regulation members having different sizes are provided.

6. The speaker as claimed in claim 1, wherein the regulation member is provided within a grooved portion of the groove rib.

7. A speaker diaphragm comprising:

a diaphragm main body integrally formed with an edge portion around outer circumference thereof;

a groove rib integrally formed in the edge portion;

a regulation member provided on a part of the front or back face of the edge portion, and adapted to partially improve a flexural strength of the edge portion.

8. The speaker diaphragm as claimed in claim 7, wherein the regulation member is formed by applying an adhesive.

9. The speaker diaphragm as claimed in claim 7, wherein the regulation member is formed by applying an agglutinant.

10. The speaker diaphragm as claimed in claim 7, wherein a plurality of the regulation members made of different materials are provided.

11. The speaker diaphragm as claimed in claim 7, wherein a plurality of the regulation members having different sizes are provided.

12. The speaker diaphragm as claimed in claim 7, wherein the regulation member is provided within a grooved portion of the groove rib.

* * * * *